United States Patent [19]

Craycraft

[11] Patent Number: 4,953,808

[45] Date of Patent: Sep. 4, 1990

[54] APPARATUS FOR SUPPLYING A SHEET METAL STRIP TO A PRESS

[75] Inventor: Michael R. Craycraft, Piqua, Ohio

[73] Assignee: Perfecto Industries, Inc., Piqua, Ohio

[21] Appl. No.: 229,348

[22] Filed: Aug. 8, 1988

[51] Int. Cl.[5] ..... B65H 59/00; B65H 23/22

[52] U.S. Cl. ..... 242/78.6; 242/75.51; 242/75.45; 242/75.3; 226/45

[58] Field of Search ..... 242/67.3 R, 75.3, 75.43, 242/75.44, 75.51, 78.6; 226/42–44, 27, 28

[56] References Cited

U.S. PATENT DOCUMENTS

| | | | |
|---|---|---|---|
| 3,177,749 | 4/1965 | Best et al. | 226/42 X |
| 3,774,016 | 11/1973 | Sterns et al. | 226/28 X |
| 3,888,430 | 6/1975 | Costello et al. | 242/78.6 X |
| 3,987,750 | 10/1976 | Knapke | 118/44 X |
| 4,057,185 | 11/1977 | Slama et al. | 226/1 |
| 4,384,665 | 5/1983 | Waddington | 242/75.51 X |
| 4,447,016 | 5/1984 | Enberg et al. | 242/56.9 |
| 4,561,581 | 12/1985 | Kelly | 226/42 X |
| 4,573,618 | 3/1986 | Kikuchi | 226/42 |
| 4,757,930 | 7/1988 | Ditto | 226/27 |

*Primary Examiner*—Stuart S. Levy
*Assistant Examiner*—Steven M. duBois
*Attorney, Agent, or Firm*—Jacox & Meckstroth

[57] ABSTRACT

A variable speed D.C. drive is effective to feed a web or strip of sheet metal from a supply coil supported by a pay-off reel to an intermittant stock feeder for a reciprocating mechanical press. The drive is operated by a computer control system according to a predetermined program, and the system includes sensors for monitoring the surface speed of the strip extending from the coil, the reciprocating movement of the press and changes in a loop formed within the strip between the supply coil and the stock feeder. The drive is connected to rotate the coil support mandrel for the pay-off reel or a set of pinch rolls which pull the strip from the coil.

15 Claims, 1 Drawing Sheet

APPARATUS FOR SUPPLYING A SHEET METAL STRIP TO A PRESS

BACKGROUND OF THE INVENTION

In the feeding of a sheet metal web or strip from a supply coil into a mechanical reciprocating press, the supply coil is usually supported by a pay-off reel, and either the coil is driven in an unwinding direction by a variable speed hydraulic motor or the strip is pulled from the coil by a set of driven pinch rolls such as used on a strip straightening device. A loop is formed within the metal strip between the supply coil and a stock feeder which is operated in timed relation with the reciprocating press and advances the strip into the press in predetermined increments. Commonly, the motor which unwinds the supply coil is controlled by either optical or sonic detectors which detect vertical movement in the bottom of the loop. When the bottom of the loop moves up, the unwinding of the coil is automatically increased. One type of optical loop detectors or sensors is disclosed in U.S. Pat. No. 4,447,016 which issued to the Assignee of the present invention.

When a large supply coil is used, for example, a coil weighing 25,000 pounds or more, the rotating coil has substantial momentum which can result in producing problems in obtaining precision incremental feeding of the strip into the press by the stock feeder. For example, substantial variation in the loop results in significant changes in the weight of the strip forming the loop, and these changes and/or jerking of the loop result in substantial variations in the tension within the strip ahead of the stock feeder. This change in tension makes it more difficult for the stock feeder to obtain precision feeding of the strip, especially when the speed of the press and stock feeder are increased to obtain maximum production from the press.

SUMMARY OF THE INVENTION

The present invention is directed to improved apparatus for precisely supplying or feeding a strip of sheet metal from a coil on a pay-off reel to a reciprocating press and which automatically increases or decreases with changes in the speed of the press while maintaining substantially constant tension within the strip ahead of the press. The apparatus of the invention is ideally suited for use with a heavy supply coil of sheet metal and maintains a substantially constant loop within the strip independent of the line speed or coil size or the type of stock feeder which intermittently feeds the strip into the press. In addition, the apparatus of the invention is dependable in operation, is less expensive than prior control systems and provides for measuring the amount of strip being fed from the supply coil.

In accordance with one embodiment of the invention, the above features and advantages are generally provided by apparatus including a computer control system which monitors the reciprocating operation of the press, the surface speed of the strip being fed from the supply coil and small changes in the bottom of the loop within the strip for controlling a variable speed drive connected to feed the strip from the supply coil. The surface speed of the strip is monitored by a measuring wheel mounted on the shaft of an encoder which supplies pulses to a counter and central processing unit. The unit controls a digital-to-analog convertor for varying the voltage to the drive which feeds the strip from the supply coil. A set of vertically spaced optical detectors sense the bottom of a loop within the strip and also provide for supplying a digital input into the convertor. The system also incorporates a rotary cam switch which senses the reciprocation or each stroke of the mechanical press, and pulses from the switch are also supplied to the convertor.

Other features and advantages of the invention will be apparent from the following description, the accompanying drawing and the appended claims.

DESCRIPTION OF THE PREFERRED EMBODIMENTS

Figure 1:
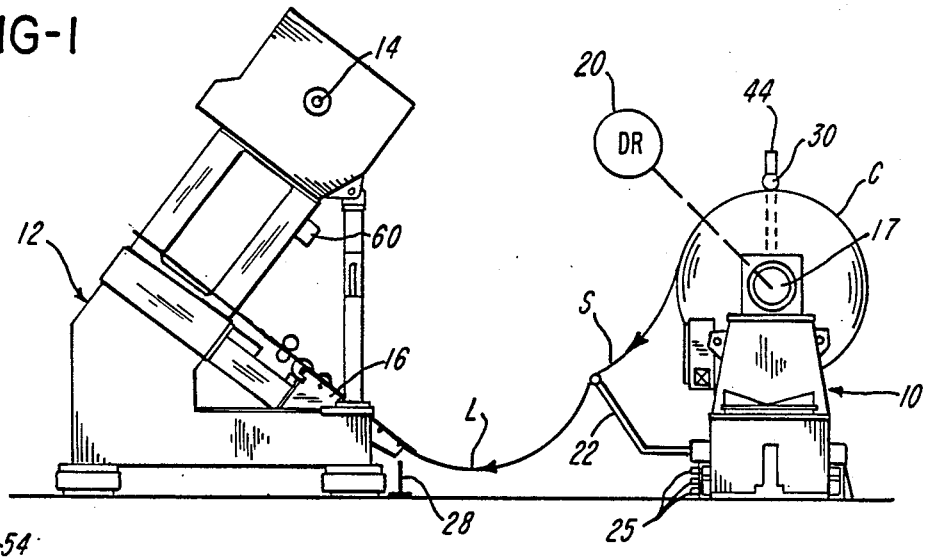
FIG. 1 is an elevational view of a sheet metal supply coil supported by a pay-off reel and from which a strip is supplied to the feeder for a mechanical press under the control of apparatus constructed in accordance with the invention.

FIG. 1 illustrates apparatus for supplying a sheet metal strip S from a supply coil C supported by a pay-off reel 10 into a mechanical press 12 having a reciprocating platen driven by a shaft 14. This strip S is fed into the press 12 by a stock feeder 16, such as, for example, the Model 312-4 or Model 500 feeders manufactured by applicant's assignee, Perfecto Industries, Inc. in Piqua, Ohio and sold under the trademark PERFECTO. A suitable pay-off reel 10 is also manufactured by applicant's assignee and marketed as the PERFECTO Model RS-25 or Model 200-52. The coil C is supported by an expandable mandrel 17 which is driven by a variable speed drive 20 in the form of a hydraulic motor controlled by a variable voltage valve. A strip guide member 22 extends from the reel 10 and supports the strip S, and a generally U-shaped loop L is formed within the strip between the support member 22 and the stock feeder 16.

Figure 2:
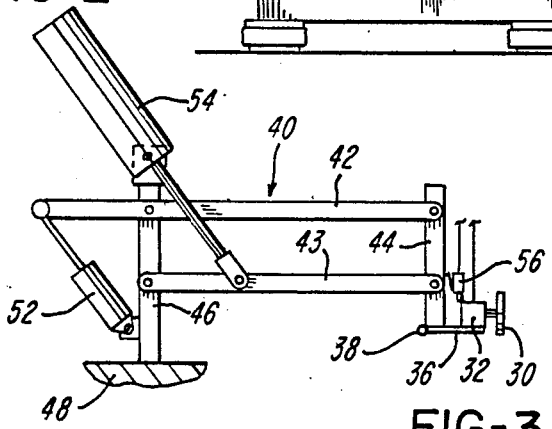
FIG. 2 is a somewhat diagramatic elevational view of a mechanism for supporting the strip measuring wheel shown in FIG. 1 and positioned to engage the strip forming the outer wrap of the coil.

A series of vertically spaced light transmitting and receiving units or detectors 25 are supported by the pay-off reel 10 and cooperate with a vertical reflector 28 to detect the elevation of the bottom of the loop L within the strip S as the strip feeds from the coil C to the stock feeder 16. Referring to FIGS. 1 & 2, a measuring wheel 30 is mounted on the shaft of a digital encoder 32, and the encoder is supported for movement relative to the coil C so that the wheel 30 maintains frictional engagement with the outer wrap of the strip S forming the coil C as the coil decreases in diameter.

As shown in FIG. 2, the encoder 32 is mounted on a support plate 36 which has a pivot connection 38 with a parallelogram-type support mechanism 40. The mechanism 40 includes parallel spaced arms 42 and 43 having pivot connections with an outer support post 44 and an inner support post 46 which is mounted on a base 48 secured to the pay-off reel 10. A set of fluid cylinders 52 and 54 connect the arms 42 and 43 to the support post 46 and serve to counterbalance the weight of the support system 40, the encoder 32 and the measuring wheel 30 and to retract the wheel from the coil when replacing coils. A limit switch 56 is carried by the encoder 32 and senses when the plate 36 pivots relative to the post 44 and the measuring wheel 30 is out of engagement with the coil C. Referring to FIG. 1, a rotary cam switch unit 60 is mounted on the press 12 and senses the reciprocating stroke of the upper press platen.

Figure 3:
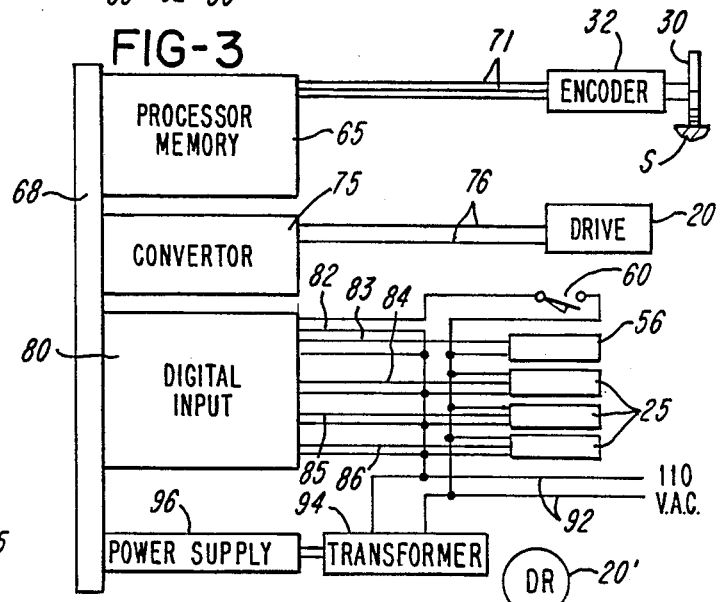
FIG. 3 is a block diagram of the control apparatus of the invention.

Referring to FIG. 3, a central processing unit 65 is mounted on a standard bus backplane 68 and is connected by conductors 71 to the encoder 32. A power supply of 5 volts D.C. is supplied to the encoder 32 from the unit 65, and the digital pulses produced by the encoder 32 in response to rotation of the measuring wheel 30 are counted in the unit 65 and processed according to a predetermined program. One form of unit 65 which has provided satisfactory results is produced by Ziatech Corporation and identified as the MINI-DOS-8806AE-OPT539. A digital-to-analog convertor 75 is also mounted on the backplane 68 and is connected by conductors 76 to drive the variable speed drive 20 for the coil support mandrel. From 0 to 10 volts D.C. are supplied to the drive 20 according to the desired rotation of the coil C. One form of convertor which has provided satisfactory results is produced by Versalogic Corporation and identified as part No. AOUT-1.

The backplane 68 also receives a digital input controller unit 80 which is also produced by Versalogic Corporation and identified as part No. IPI-1. The controller unit 80 is connected by a set of conductors 82–86 to the press cam switch 60, limit switch 56 and loop elevation detectors 25. A 110 volt A.C. power supply is connected by the conductors 92 to the detectors 25 and switches 56 and 60 and also to a tranformer 94 which provides a 24 volt A.C. current to a low voltage power supply 96 mounted on the backplane 68. One power supply 96 which has provided satisfactory results is produced by Versalogic Corporation which also produces an acceptable standard bus backplane 68, identified as part No. G5.

In operation of the strip supply system described above in connection with FIGS. 1–3, when the press 12 is operating, the strip supply system is controlled by the central processing unit 65 according to the program transferred into its memory. The material or strip S is drawn from the loop L and advanced in increments to the press 12 by the stock feeder 16 until the bottom of the loop exposes the lowermost detector 25. When this occurs, the drive unit 20 is commanded to run at a minimum speed which is determined by the operational speed of the press and the selected incremental feed length of the strip as provided by the stock feeder 16. The convertor 75 supplies from 0 to 10 volts D.C. to the drive unit 20, and as the strip S is fed from the coil C, the encoder 32 sends pulses to the counter within the unit 65 for measuring the speed of the strip extending from the coil C. With each stroke of the press 12, a pulse or signal is produced by the rotary cam switch unit 60, and the pulse instructs the computer to check if a proper amount of material was replaced in the loop L since the last stroke. If excess material is replaced, the command to the drive unit 20 is decreased so that the feed rate of the strip S is decreased. If insufficient material is replaced in the loop L, the command to the drive unit 20 is increased.

If for some reason, material is drawn from the loop L more quickly than the speed of the drive unit 20 can respond, the loop L shortens so that the second or middle loop detector unit 25 is exposed, and the drive unit 20 is commanded to run at a higher speed as determined by the feed length of the strip and the maximum speed of the press. If the top or uppermost loop detector unit 25 is exposed, the drive unit 20 is commanded to operate at full speed. If for some reason the measuring wheel 30 is not in frictional drive engagement with the strip S, the encoder 32 pivots downwardly relative to the post 44 to open the limit switch 56, and the control system is prevented from operating.

Figure 4:
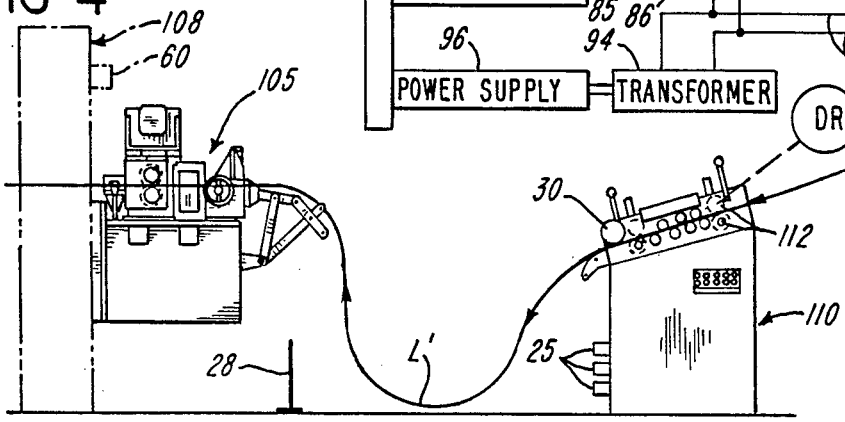
FIG. 4 is an elevational view of a press feeder in combination with a strip straightener and also incorporating the control apparatus of the invention.

Referring to FIG. 4, a loop L′ is formed within the strip S′ between a stock feeder 105 for a mechanical press 108 and a strip straightener 110. A set of pinch rolls 112 are incorporated within the straightener 110 and are driven by a drive unit 20′ which consists of a variable speed D.C. motor. The drive unit 20′ replaces the drive unit 20, and the pinch rolls 112 pull the strip S from a coil supported for rotation by a pay-off reel. In the embodiment of FIG. 4, the measuring wheel 30 and the encoder 32 are supported by the straightener 110 with the measuring wheel 30 in frictional drive engagement with the strip S′. The apparatus disclosed in connection with FIG. 4 is operated in the same manner as the apparatus described above in connection with FIGS. 1–3 and uses the same control system as shown in FIG. 3 with the exception that the drive unit 20′ replaces the drive unit 20. A strip straightener 110 which performs satisfactorily is manufactured by applicant's assignee and sold under the trademark PERFECTO.

It is also within the scope of the invention to use the control apparatus or system described above in combination with a strip lubricator (not shown) which may replace the straightener 110 or be used in combination with the straightener. Such a lubricator is manufactured by applicant's assignee and also sold under the trademark PERFECTO and is of the general type as disclosed in U.S. Pat. No. 3,987,750 which issued to the predecessor of applicant's assignee. The lubricator incorporates a set of pinch rolls which are driven by the drive unit 20′ in the same manner as the pinch rolls 112 in the strip straightener 110, and the measuring wheel 30 and encoder 32 are supported by the lubricator.

From the drawing and the above description, it is apparent that apparatus constructed in accordance with the present invention for controlling the feed of a strip from a supply coil to a mechanical press, provides desirable features and advantages. For example, by monitoring the speed of the press, the strip speed from the supply coil and the location of the loop, and by using these inputs to control the drive for paying-off the strip from the coil, the size of the loop may be minimized and the speed of the press and stock feeder may be increased without producing significant changes in tension of the strip ahead of the stock feeder. As a result, more precision feeding of the strip may be obtained by the stock feeder, and the supply coil is provided with more uniform rotation to avoid jerks or violence within the strip extending from the supply coil to the stock feeder. The apparatus of the invention is also independent of the type of stock feeder or the coil size and maintains a substantially constant loop height regardless of the line speed or coil size.

While the forms of apparatus herein described constitute preferred embodiments of the invention, it is to be understood that the invention is not limited to these precise forms of apparatus, and that changes may be made therein without departing from the scope and spirit of the invention as defined in the appended claims.

The invention having thus been described, the following is claimed:

1. Apparatus for controlling the feeding of a strip of metal from a supply coil on a pay-off reel to a reciprocating press requiring intermittent and incremental advancement of the strip into the press, said apparatus comprising a variable speed drive connected to feed the strip from the coil, strip speed sensing means for detecting the rate of longitudinal movement of the strip being fed from the supply coil in response to operation of said drive, strip feeding means for intermittently advancing the strip in successive increments into the press, press sensing means for detecting the rate of reciprocating operation of the press, loop sensing means for detecting elevation changes in the bottom of a generally U-shaped loop formed in the strip between said strip speed sensing means and said strip feeding means, and computer control means connected for automatically changing the speed of said drive in response to signals received from said loop sensing means, said press sensing means and said strip speed sensing means.

2. Apparatus as defined in claim 1 wherein said strip speed sensing means comprise a measuring wheel having a frictional drive engagement with the strip, and a digital encoder having a shaft driven by said wheel.

3. Apparatus as defined in claim 2 and including means supporting said encoder and measuring wheel for movement relative to the supply coil for maintaining contact between said wheel and the strip as the coil decreases in diameter.

4. Apparatus as defined in claim 3 wherein said control means include a limit switch disposed for sensing when said wheel is out of contact with the strip.

5. Apparatus as defined in claim 2 wherein said electrical control means comprise a digital-to-analog convertor connected to receive digital pulses from said encoder through a central processing unit for controlling the speed of said drive.

6. Apparatus as defined in claim 5 wherein said loop sensing means comprise a plurality of vertically spaced light sending and receiving units connected to said convertor through a digital input unit.

7. Apparatus as defined in claim 1 wherein said variable speed drive comprises a hydraulic motor connected to drive said pay-off reel, and a variable voltage hydraulic valve connected to control the speed of said motor.

8. Apparatus as defined in claim 1 wherein said variable speed drive comprise a set of pinch rolls disposed for receiving the strip extending from the coil, and a variable speed motor connected to drive said pinch rolls.

9. Apparatus as defined in claim 1 and further including a strip straightener having a set of pinch rolls disposed for receiving the strip extending from the coil, said drive comprises a variable speed motor connected to drive said pinch rolls, and said strip speed sensing means is supported by said straightener.

10. Apparatus for controlling the feeding of a strip of metal from a supply coil on a pay-off reel to a reciprocating press requiring intermittent and incremental advancement of the strip into the press, said apparatus comprising a variable speed drive connected to feed the strip from the coil, a digital encoder having a strip contact wheel for detecting the rate of longitudinal movement of the strip being fed from the supply coil in response to operation of said drive, a stock feeder operated in timed relation with the press for intermittently advancing the strip in successive increments into the press, press switch means for detecting the rate of reciprocating operation of the press, loop sensing means for detecting elevation changes in the bottom of a generally U-shaped loop formed in the strip between the pay-off reel and said stock feeder, and computer control means connected for automatically changing the speed of said drive in response to signals received from said loop sensing means, said press switch means and said encoder.

11. Apparatus as defined in claim 10 wherein said computer control means comprise a digital-to-analog convertor connected to receive digital pulses from said encoder through a central processing unit for controlling the speed of said drive.

12. Apparatus as defined in claim 10 wherein said variable speed drive comprises a hydraulic motor connected to drive said pay-off reel, and a variable voltage hydraulic valve connected to control the speed of said motor.

13. Apparatus as defined in claim 10 wherein said variable speed drive comprise a set of pinch rolls disposed for receiving the strip extending from the coil, and a variable speed electric motor connected to drive said pinch rolls.

14. Apparatus as defined in claim 10 and further including a strip straightener having a set of pinch rolls disposed for receiving the strip extending from the coil, said drive comprises a variable speed electric motor connected to drive said pinch rolls, and said encoder and contact wheel are supported by said straightener.

15. Apparatus for controlling the feeding of a strip of material from a supply coil on a pay-off reel to a reciprocating press requiring intermittent and incremental advancement of the strip into the press, said apparatus comprising a variable speed drive connected to feed the strip from the coil, a digital encoder having a strip contact wheel for detecting the rate of longitudinal movement of the strip being fed from the supply coil in response to operation of said drive, a stock feeder operated in timed relation with the press for intermittently advancing the strip in successive increments into the press, press switch means for detecting the rate of reciprocating operation of the press, loop sensing means for detecting elevation changes in the bottom of a generally U-shaped loop formed in the strip between the pay-off reel and said stock feeder, electrical control means connected for changing the speed of said drive in response to signals received from said loop sensing means, said press switch means and said encoder, and means supporting said encoder and contact wheel for movement relative to the supply coil for maintaining contact between said wheel and the strip as the coil decreases in diameter.

* * * * *